United States Patent [19]

Guarascio

[11] Patent Number: 5,072,486

[45] Date of Patent: Dec. 17, 1991

[54] GAS ASSISTED SCRAPER

[76] Inventor: Steve Guarascio, 253-08, 147th Rd., Rosedale, N.Y. 11422

[21] Appl. No.: 510,169

[22] Filed: Apr. 17, 1990

[51] Int. Cl.[5] ..... A47L 9/06; A47L 9/08

[52] U.S. Cl. ..... 15/401; 15/236.01; 15/405

[58] Field of Search ..... 15/401, 402, 236.01, 15/405

[56] References Cited

U.S. PATENT DOCUMENTS

| | | | |
|---|---|---|---|
| 695,967 | 3/1902 | Thurman | 15/405 X |
| 1,557,994 | 10/1925 | Dyson et al. | 15/405 X |
| 1,598,811 | 9/1926 | Ferrin | 15/236.01 X |
| 1,747,258 | 2/1930 | O'Neil et al. | 15/401 X |
| 1,945,810 | 2/1934 | Holtz | 15/405 X |
| 2,394,760 | 2/1946 | Felton | 15/401 X |
| 2,443,602 | 6/1948 | Clark | 15/236.01 X |
| 2,908,962 | 10/1959 | Wagner | 15/405 X |
| 4,243,178 | 1/1981 | Self | 15/405 X |
| 4,403,371 | 9/1983 | Kiyooka | 15/401 X |
| 4,446,593 | 5/1984 | Bell et al. | 15/322 |

*Primary Examiner*—Chris K. Moore

*Attorney, Agent, or Firm*—Lieberman Rudolph & Nowak

[57] ABSTRACT

The subject invention provides a gas assisted scraper which provides a wet or dry spray for dispersing debris from the scraper and surface being scraped. The gas assisted scraper comprises a handle, a scraping portion, gas outlet, and means for supplying a gas to the gas outlet. The scraping portion is connected to the handle and has a scraping edge configured in such a manner so as to permit the scraping of a surface by the scraping edge by pushing the handle with a force in a generally forward direction over the surface. The scraping portion, scraping edge and handle are generally aligned in a direction parallel with the force applied to the handle during scraping of a surface. The gas outlet is proximate to the scraping edge and is configured so as to direct gas in a forward direction toward the scraping edge generally parallel to the force applied to the handle. This invention has a multitude of uses and is practical for home and commercial applications involving removal of grease, dirt, paint, etc.

16 Claims, 4 Drawing Sheets

GAS ASSISTED SCRAPER

BACKGROUND OF THE INVENTION

The subject invention provides an gas assisted scraper which is preferably connectable to a standard air gun. This apparatus is useful for a multitude of scraping applications such as scraping grease, dirt and gaskets from automotive parts, scraping paint and other finishes from surfaces, and scraping wax or gum from floorings. The subject invention additionally offers the advantage of a wet or dry mode for dispersing scraped material.

Scrapers using gas flow have been described in the prior art. However, no scraper has been disclosed which provides a stream of gas directly above the scraper blade to assist in removing the scraped debris.

Thoma U.S. Pat. No. 4,404,705, issued Sept. 20, 1983 discloses a hand-held scraping device for de-icing frozen car windows utilizing exhaust fumes for softening or melting the layer of ice. This invention, however, does not utilize an gas source to disperse debris, but rather uses heat to melt snow or ice. Likewise, Leher U.S. Pat. No. 2,481,760, issued Sept. 13, 1949 uses highly super-heated steam applied above a scraper to melt old paint which is removed by the scraper.

A spark plug cleaner is described in Itjem U.S. Pat. No. 1,643,606, issued Sept. 27, 1927. This invention provides a externally threaded tubular portion which may be engaged to an gas source. The opposite end of the cleaner has a semi-conical end having a bore terminating in an opening at the flat side of the pointed end of the body.

A scraping and caulking tool for ships is described in Clark U.S. Pat. No. 2,443,602, issued June 22, 1948. This device uses compressed gas to disperse debris. However, this invention utilizes a pulling as opposed to pushing action and distributes the air almost perpendicular to the blade.

McGrath U.S. Pat. No. 1,642.933, issued Sept. 20, 1927 discloses a device for washing dishes and the like. McGrath describes a scraper device which discharges water through a nozzle in the a thin fan-like spray to disperse scrapings from the article being washed.

The subject invention provides means for scraping surfaces that generate scrapings which impede conventional scrapers or the scraping process. In particular, debris are removed so that they do not foul equipment or surfaces adjacent to the area being scraped. In the wet mode, grease may be dispersed by a solvent so that it is readily removed from the surface and does not build up on the surface of the scraper thereby permitting efficient scraping of the surface.

SUMMARY OF THE INVENTION

The subject invention provides a gas assisted scraper which comprises a handle; a scraping portion connected to the handle and having a scraping edge configured in such a manner so as to permit the scraping of a surface by the scraping edge by pushing the handle with a force in a generally forward direction over the surface, the scraping portion, scraping edge and handle being generally aligned in a direction parallel with the force applied to the handle during scraping of a surface; a gas outlet proximate to the scraping edge configured so as to direct gas in a forward direction toward the scraping edge generally parallel to the force applied to the handle; and means for supplying a gas to the gas outlet.

BRIEF DESCRIPTION OF THE FIGURES

FIG. 4A Top view of a curved tip for the gas assisted scraper.

FIG. 4B Top view of a V-shaped tip for the gas assisted scraper.

FIG. 4C Top view of a straight tip (angled) for the gas assisted scraper.

FIG. 4D Top view of a serrated tip for the gas assisted scraper.

DETAILED DESCRIPTION OF THE INVENTION

Figure 1:
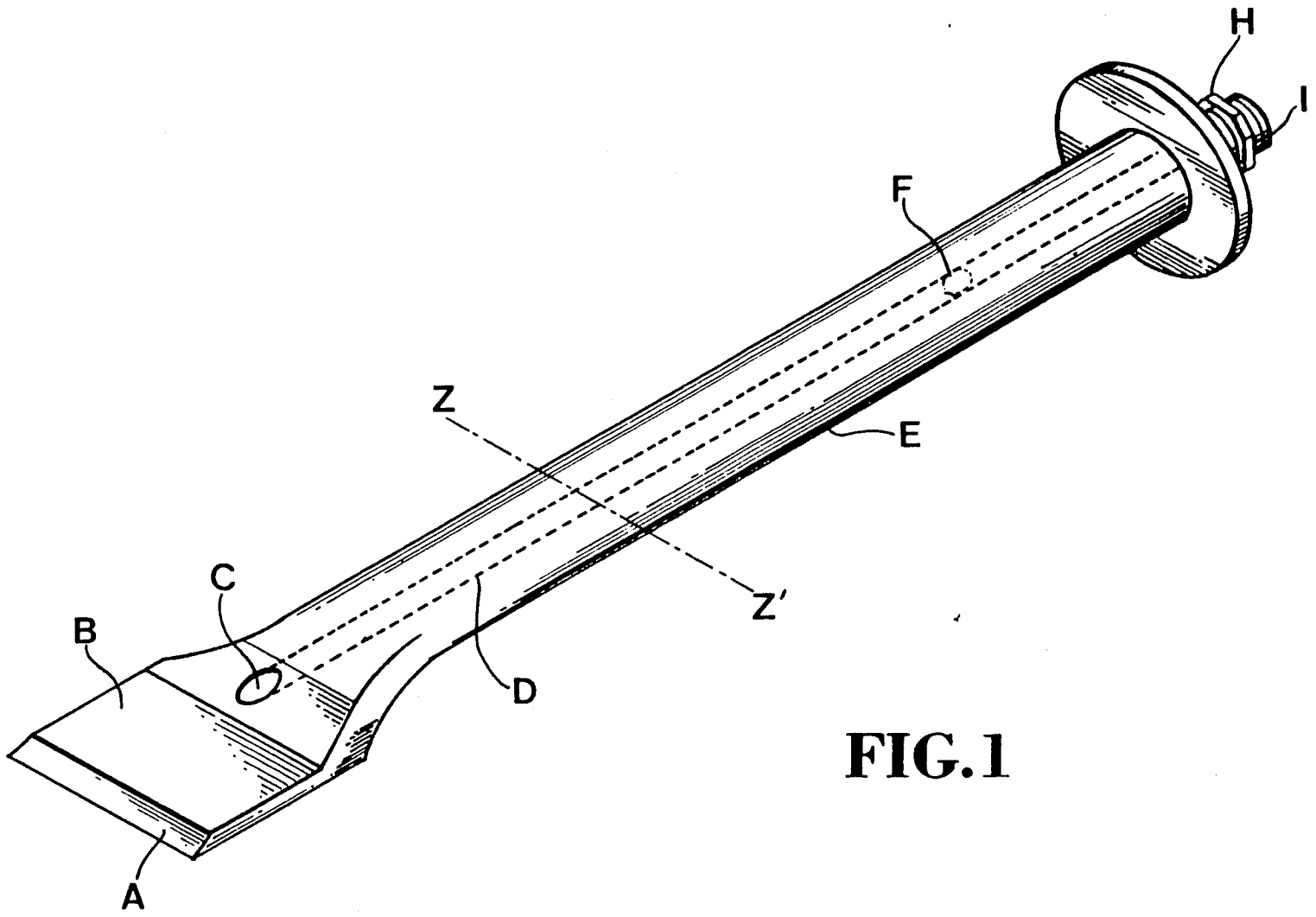
FIG. 1 Perspective view of the gas assisted scraper.
Figure 2:
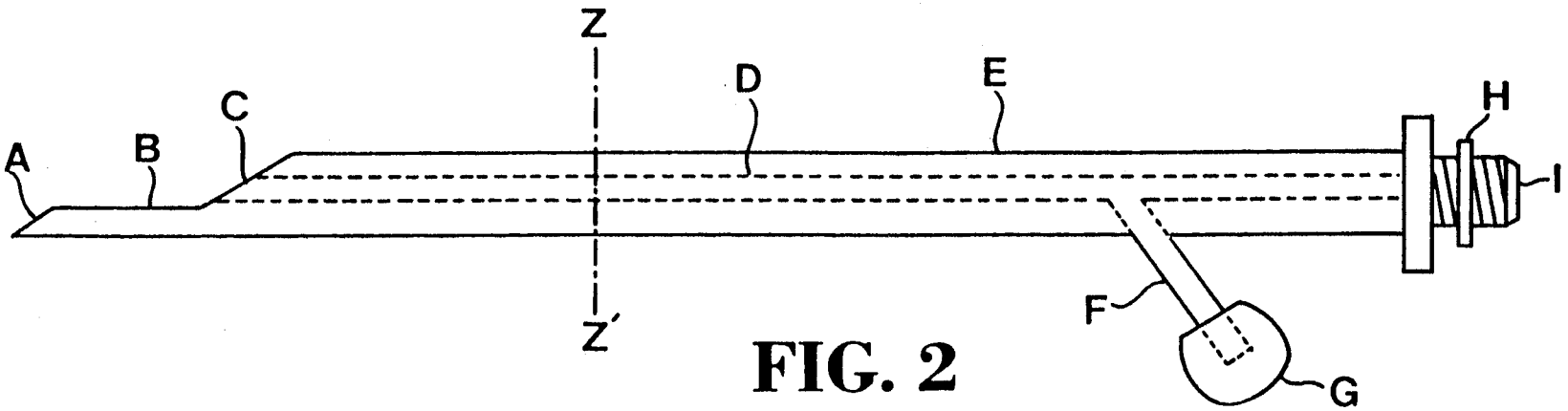
FIG. 2 Side view of the gas assisted scraper.
Figure 3:
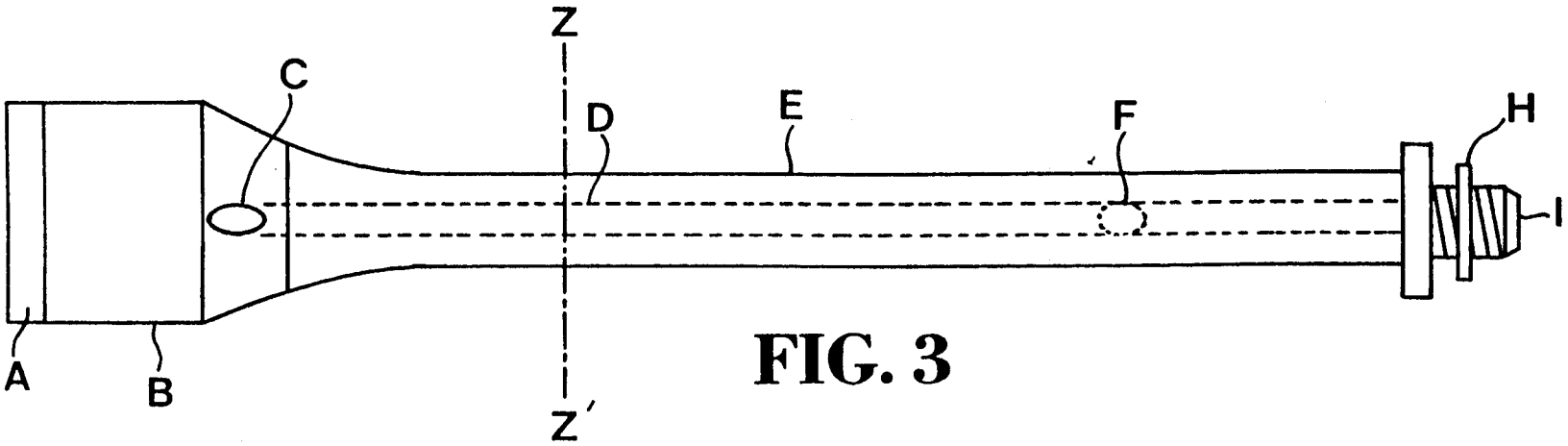
FIG. 3 Top view of the gas assisted scraper.
Figure 4A:
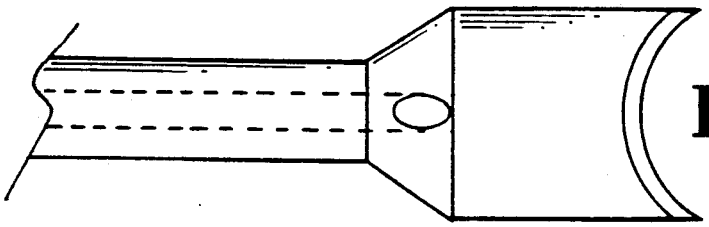
Figure 4B:
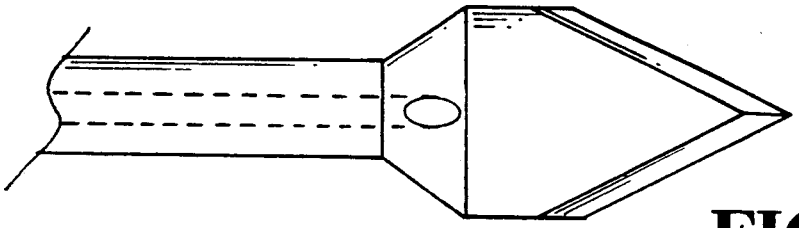
Figure 4C:
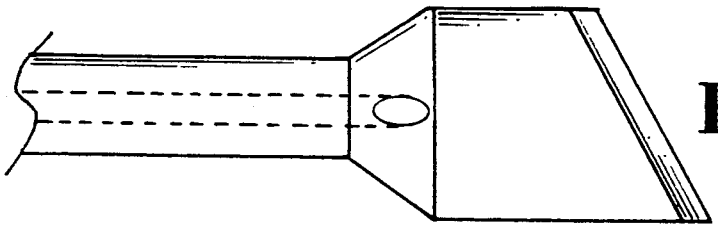
Figure 4D:
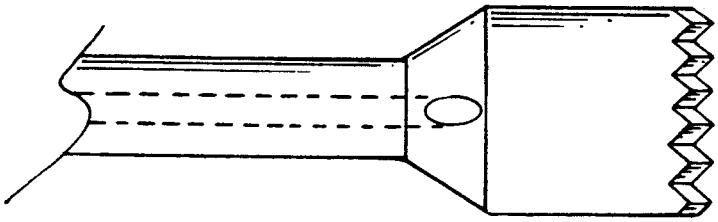

The subject invention provides a gas assisted scraper which is useful for a variety of applications involving removing material from a surface and providing a means for dispersing the scraped material from the surface being scraped and from the scraping portion of the scraper.

The gas assisted scraper comprises a handle, a scraping portion, gas outlet, and means for supplying a gas to the gas outlet. The scraping portion is connected to the handle and has a scraping edge configured in such a manner so as to permit the scraping of a surface by the scraping edge by pushing the handle with a force in a generally forward direction over the surface. The scraping portion, scraping edge and handle are generally aligned in a direction parallel with the force applied to the handle during scraping of a surface. The gas outlet is proximate to the scraping edge and is configured so as to direct gas in a forward direction toward the scraping edge generally parallel to the force applied to the handle.

The subject invention provides a gas assisted scraper which provides either a wet or dry spray for dispersing debris from the scraper and surface being scraped. This invention has a multitude of uses and is practical for home and commercial applications involving removal of grease, dirt, paint, etc.

The scraper described herein may be made in a variety of sizes to accommodate the needs of a particular job. Typically, the scraper may have a scraping edge of from about one to about two inches in width, and an overall length of from about 6 to about 10 inches. However, microscrapers for use in precision work and giant mechanically assisted scrapers are also to be encompassed by the subject invention.

The type of gas used for dispersing debris may be of any type practical for a given task. For example, if flammability is a possible hazard the gas may be nitrogen, carbon dioxide or argon. Likewise, the source of gas may be any source capable of dispersing scrapings, the choice of gas source being readily determinable to one skilled in the art. The most common embodiment is where the subject invention uses a source of compressed air, most preferably supplied by an air gun.

The figures demonstrate a preferred embodiment of the subject invention and will be used to illustrate the invention in general. The figures and the discussion of the preferred embodiments hereinbelow are not intended to, and should not be construed to, limit in any way the invention as set forth in the claims which follow hereinafter. Upon reading the present disclosure, other embodiments of the invention will become apparent to those skilled in the art. These embodiment are contemplated to be within the spirit and scope of the present invention.

The scraping edge (A) is a part of the scraping portion (B) which is connected to the handle (E) in such a manner so that (A) (B) and (E) are generally aligned in a direction parallel to the force applied to the handle. As such, the scraping edge and portion need not be flat as depicted in the figures. For example, the scraping portion may be bent along a line parallel with the handle so as to form a V-shaped scraping portion useful for disgorging material from crevices. Another embodiment is where the scraping edge is serrated so as to dig into the surface being scraped. Other configurations that generally align in a direction parallel to the force applied to the handle are also within the scope of this invention. FIGS. 4A, 4B, 4C and 4D show the various tips herein described.

The subject invention requires means for supplying a gas to the gas outlet (C), which is located proximate to the scraping edge. In the embodiment depicted in the figures, a gas is supplied to the gas outlet via a tube (D) which runs the length of the handle and terminates with a threaded end (I) which may be attached to a source of gas. Typically, the source of gas will be supplied from an air compressor via an air gun. In other embodiments, a tank of compressed gas supplies the source of gas. The threaded end may further comprise a nut (H) or nut/washer combination useful for tightening against the source of gas. The nut is threaded to correspond to the thread of the threaded end with the choice of nut or nut/washer combination being readily determinable to one skilled in the art. However, in the preferred embodiment, the nut is a hex nut as shown in the figures.

The handle is depicted as having a tube transversing the entire length of the handle. In other embodiments of the invention, the handle may comprise a passageway that serves the same function as the tube. The passageway may be a void that permits the flow of gas. Typically, this void will be a bore hole through a forged tool steel scraper. The end of the tube or passageway, is capable of attaching to a source of gas and may be any connector means capable of supplying gas to the gas outlet. The connector means depicted in the figures is a male screw thread which may be screwed into the female receptacle of an air gun. However, any connector means known to one skilled in the art may be used.

Figures 5, 5A, 5B:
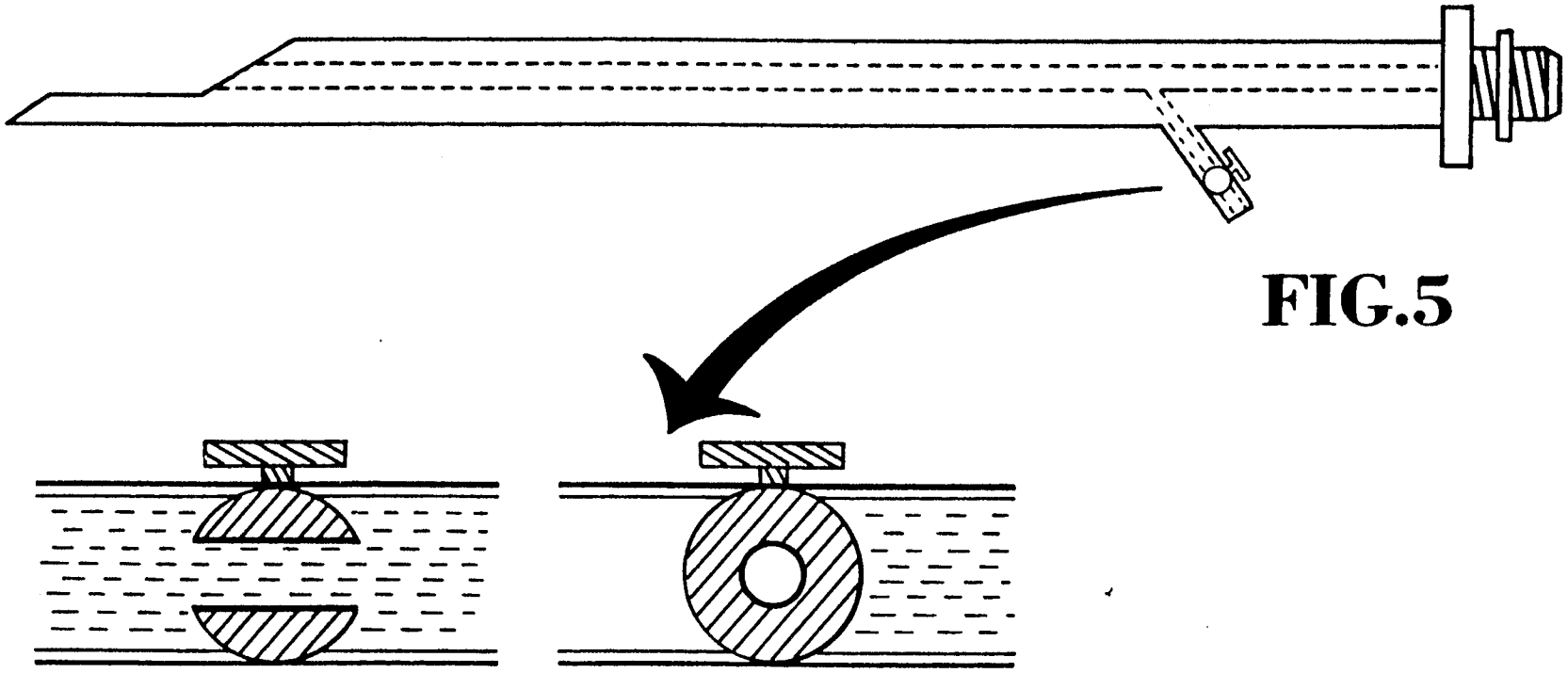
FIG. 5 Side view of the gas assisted scraper showing a valve on the second tube.
FIG. 5A Exploded view of the valve in the open position.
FIG. 5B Exploded view of the valve in the closed position.

The figures illustrate a preferred embodiment wherein the tube that runs through the handle and connects to the gas outlet is sealingly connected to a second tube (F) so as to allow communication between the interiors of both tubes. The second tube may be sealed with a cap (G) or valve. FIG. 5 illustrates the use of a valve on the second tube.

The second tube may comprise a means for feeding a fluid. Typically, the fluid is a solvent which is used to dissolve grease on the surface being scraped or the scraping portion of the scraper. The angle formed between the portion of the tube connected to the gas outlet forward of the point at which the two tubes intersect and second tube is preferably an obtuse angle, the angle being such that a lower pressure is created in the second tube when gas flows through the tube to the gas outlet. If the second tube is connected to a source of fluid, the fluid is drawn by the lower pressure into the tube and expelled with the gas through the gas outlet.

Although the tube connected to the gas outlet is depicted as transversing the length of the handle, the tube may also be attached to the handle or independent of the handle. For example, the tube may run directly from the gas outlet to a source of gas. In large scale industrial applications, the means for supplying a gas to the gas outlet may be mounted on the scraper in direct connection to the gas outlet.

Not depicted in the figures is a shield. Typically, the shield is connected to the handle and configured in such a manner so that scrapings generated during the scraping of a surface are excluded from the vicinity of the handle. An example of such a shield would be a circle of plexiglass having a hole cut through the middle to accommodate the handle. The shield generally would be located in a position forward of the area of the handle to which force is applied, for example along line z—z'. The effect of the shield is to protect the user and in particular the user's hand from the scrapings which are produced by the scraper.

What is claimed is:

1. A gas assisted scraper which comprises:

(a) a handle having a passageway therein, the passageway having an end capable of being attached to a source of gas;

(b) a scraping portion connected to the handle and having a scraping edge configured in such a manner so as to permit the scraping of a surface by the scraping edge by pushing the handle with a force in a generally forward direction over the surface, the scraping portion, scraping edge and handle being generally aligned in a direction parallel with the force applied to the handle during scraping of a surface;

(c) a gas outlet connected to the passageway at the end opposite the end capable of being attached to a source of gas and proximate to the scraping edge, the gas outlet being configured so as to direct gas in a forward direction toward the scraping edge generally parallel to the force applied to the handle;

(d) means for supplying a gas to the gas outlet; and (e) a shield connected to the handle.

2. A scraper of claim 1, wherein the scraping edge is V-shaped.

3. A scraper of claim 1, wherein the scraping edge is curved.

4. A scraper of claim 1, wherein the scraping edge is serrated.

5. A gas assisted scraper which comprises:

(a) a handle having a passageway therein, the passageway having a threaded end capable of being attached to a source of gas;

(b) a scraping portion connected to the handle and having a scraping edge configured in such a manner so as to permit the scraping of a surface by the scraping edge by pushing the handle with a force in a generally forward direction over the surface, the scraping portion, scraping edge and handle being generally aligned in a direction parallel with the force applied to the handle during scraping of a surface;

(c) a gas outlet connected to the passageway at the end opposite the threaded end and proximate to the scraping edge, the gas outlet being configured so as to direct gas in a forward direction toward the scraping edge generally parallel to the force applied to the handle;

(d) means for supplying a gas to the gas outlet; and (e) a shield connected to the handle.

6. A scraper of claim 5, wherein the scraping edge is V-shaped.

7. A scraper of claim 5, wherein the scraping edge is curved.

8. A scraper of claim 5, wherein the scraping edge is serrated.

9. A gas assisted scraper which comprises:

(a) a handle;

(b) a scraping portion connected to the handle and having a scraping edge configured in such a manner so as to permit the scraping of a surface by the scraping edge by pushing the handle with a force in a generally forward direction over the surface, the scraping portion, scraping edge and handle being generally aligned in a direction parallel with the force applied to the handle during scraping of a surface;

(c) a gas outlet proximate to the scraping edge configured so as to direct gas in a forward direction toward the end scraping edge generally parallel to the force applied to the handle;

(d) means for supplying a gas to the gas outlet, the means comprising a first tube connected to the gas outlet; and (e) a second tube sealingly connected with the first tube so as to allow communication between the interiors of the tubes, wherein the second tube is connected in such a manner that when gas flows through the first tube, the second tube is at a lower pressure than the first tube.

10. A scraper of claim 9, wherein the scraping edge is V-shaped.

11. A scraper of claim 9, wherein the scraping edge is curved.

12. A scraper of claim 9, wherein the scraping edge is serrated.

13. A gas assisted scraper which comprises:

(a) a handle;

(b) a scraping portion connected to the handle and having a scraping edge configured in such a manner so as to permit the scraping of a surface by the scraping edge by pushing the handle with a force in a generally forward direction over the surface, the scraping portion, scraping edge and handle being generally aligned in a direction parallel with the force applied to the handle during scraping of a surface;

(c) a gas outlet proximate to the scraping edge configured so as to direct gas in a forward direction toward the scraping edge generally parallel to the force applied to the handle;

(d) means for supplying a gas to the gas outlet, the means comprising a first tube connected to the gas outlet;

(e) a second tube sealingly connected with the first tube so as to allow communication between the interiors of the tubes; and (f) a shield connected to the handle.

14. A scraper of claim 13, wherein the scraping edge is V-shaped.

15. A scraper of claim 13, wherein the scraping edge is curved.

16. A scraper of claim 13, wherein the scraping edge is serrated.

* * * * *